US007510350B2

(12) United States Patent
Ronnkvist

(10) Patent No.: US 7,510,350 B2
(45) Date of Patent: Mar. 31, 2009

(54) HELICAL ANCHOR WITH HARDENED COUPLING SECTIONS

(76) Inventor: Thomas Ronnkvist, 1470 Westwood Dr., Minnetonka, MN (US) 55364

( * ) Notice: Subject to any disclaimer, the term of this patent is extended or adjusted under 35 U.S.C. 154(b) by 27 days.

(21) Appl. No.: 11/787,171

(22) Filed: Apr. 12, 2007

(65) Prior Publication Data

US 2007/0243025 A1 Oct. 18, 2007

Related U.S. Application Data

(60) Provisional application No. 60/791,723, filed on Apr. 13, 2006.

(51) Int. Cl.
*E02D 5/80* (2006.01)

(52) U.S. Cl. ..... 405/250; 405/231; 405/244; 405/252.1

(58) Field of Classification Search ..... 405/229–231, 405/244, 249, 251, 252.1, 250
See application file for complete search history.

(56) References Cited

U.S. PATENT DOCUMENTS

| | | | | |
|---|---|---|---|---|
| 4,432,662 | A | 2/1984 | Ronnkvist | |
| 4,678,373 | A * | 7/1987 | Langenbach, Jr. | 405/230 |
| 4,856,800 | A * | 8/1989 | Hashimoto et al. | 280/281.1 |
| 5,011,336 | A | 4/1991 | Hamilton et al. | |
| 5,120,163 | A | 6/1992 | Holdeman et al. | |
| 5,139,368 | A | 8/1992 | Hamilton et al. | |
| 5,171,107 | A | 12/1992 | Hamilton et al. | |
| 5,213,448 | A | 5/1993 | Seider et al. | |
| 5,482,407 | A | 1/1996 | Raaf | |
| RE35,335 | E * | 9/1996 | Calfee | 280/281.1 |
| 5,575,593 | A * | 11/1996 | Raaf | 405/237 |
| 5,904,447 | A | 5/1999 | Sutton et al. | |
| 5,919,005 | A | 7/1999 | Rupiper | |
| 6,503,024 | B2 | 1/2003 | Rupiper | |
| 6,615,554 | B2 | 9/2003 | Rupiper | |
| 6,659,692 | B1 | 12/2003 | May | |
| 7,004,683 | B1 | 2/2006 | Rupiper | |
| 2002/0170262 | A1 * | 11/2002 | Austin | 52/726.1 |
| 2006/0230704 | A1 * | 10/2006 | Lambreth | 52/745.02 |

FOREIGN PATENT DOCUMENTS

GB 1390821 A * 4/1975

OTHER PUBLICATIONS

Acculevel, Inc., AccuLevel Engineering Manual, 2005, St. Louis, MO 63126.

* cited by examiner

*Primary Examiner*—Tara L. Mayo
(74) *Attorney, Agent, or Firm*—Schroeder & Siegfried, P.A.

(57) ABSTRACT

A helical anchor capable of use in high load-bearing capacity applications involving extreme drive torque conditions, the anchor having a main drive shaft machine fabricated with an integrally formed hardened alloy steel coupling section that is adapted to mate with a similarly hardened and integrally formed corresponding coupling section of an extension shaft. The coupling sections are formed of seamless high-carbon heat-treated alloy steel which is quenched and tempered to a yield and tensile strength approximating 135,000 psi, and inertia friction welded to the hot-finished seamless alloy steel tubing utilized in the formation of the remainder of the drive and extension shafts.

16 Claims, 4 Drawing Sheets

HELICAL ANCHOR WITH HARDENED COUPLING SECTIONS

CROSS REFERENCE TO RELATED APPLICATIONS

This application is an application for a patent which is also disclosed in Provisional Application Ser. No. 60/791,723, filed on Apr. 13, 2006 by the same inventor, namely Thomas M. Ronnkvist, and entitled "HELICAL ANCHOR WITH HARDENED COUPLING SECTIONS," the benefit of the filing date of which is hereby claimed.

BACKGROUND OF THE INVENTION

The present invention relates generally to the field of structural pier devices which function as footings or structural supports for walls, platforms, towers, bridges, building foundations and the like, and more specifically to the improved construction of a helical anchor or pier utilized for such purposes.

The foundations of many structures, including residential homes, commercial buildings, bridges, and the like, have heretofore conventionally been constructed of concrete slabs, caissons and footings upon which the foundations walls rest. These footings, which are typically constructed of poured concrete, may or may not be in contact with a stable load-bearing underground soil structure, and the stability of the foundation walls, and ultimately the entire structure being supported, depends on the stability of the underlying soil against which the footings bear.

Oftentimes the stability of the soil, particularly near ground surface, can be unpredictable. Changing conditions over time can dramatically affect the stability of the underlying soil, thereby causing a foundation to move or settle. Such settling can cause cracking and other serious damage to the foundation walls, resulting in undesirable shifting of the supported structure, and consequent damage to windows, doors and the like. This ultimately affects the value of the building and property upon which the building is situated.

In some situations, it has been found that the soil may simply be too unstable to cost effectively utilize concrete footings as the foundation for new construction. In other situations, existing concrete foundation walls have settled, causing damage and requiring repair. In still other situations, such as in some foreign markets, the shortage of concrete and abundance of residential and commercial construction has limited the use of poured concrete footings altogether. All of the above has led to the development and advent of the screw-in helical anchor, which is the subject of the present invention.

The use of such screw-in helical anchors have become increasingly common for use as footings or underpinnings in new building construction, as well as for use in the repair of settled and damaged footings and foundations of existing buildings and other structures. Typically, in new construction, a plurality of such helical anchors are strategically positioned and hydraulically screwed into the ground to a desired depth where the underground stratum is sufficiently stable to support the desired structure. Once in place, the anchors are tied together and all interconnected by settling them within reinforced concrete. In a similar manner, such helical anchors are often positioned along portions of settling and damaged foundation walls of a structure, and utilized to repair the structure by lifting and supporting the settling foundation.

Exemplary systems utilizing Helical anchors or underpinnings of this type are disclosed in U.S. Pat. Nos. 5,011,336, 5,120,163, 5,139,368, 5,171,107, 5,213,448, 5,482,407, 5,575,593, and 6,659,692. The helical anchors in these systems will typically include at least one helical plate or flight welded to a drive shaft or column. The shaft and helical flights are generally constructed of a non-corrosive material, such as galvanized steel, to prevent deterioration of the anchor over time. Typically, the steel utilized will be a commercially available grade of about 0.18% carbon by weight, with a yield and tensile strength in the range of about 40,000-55,000 psi.

By way of example, and depending on the application, a standard round shaft starter section may consist of a round hollow hot or cold rolled welded steel tubular shaft 2-⅞" thru 7.0" O.D. typical, with one or more steel helical flights or plates of 6"-14" in diameter welded at spaced intervals thereto. The helical flights typically range in diameter with the smaller diameter flight nearer the bottom of the drive shaft to ensure that the load-bearing surface of each helix partially contacts undisturbed soil upon insertion into the ground. The pitch of the steel flights may range from 3"-6", and the starter section will have a pointed lower tip, such as by cutting the tip at a 45 degree angle.

Depending upon the application and depth required for reaching bedrock or other suitably stable strata to support the intended structure, multiple extension shafts also formed of hot or cold rolled steel, which may or may not include additional helical flighting, may be coupled to the starter shaft and each other, as needed. Heretofore, such coupling has been accomplished with the use of separate tubular coupling inserts having an outer diameter slightly smaller than the inside diameter of the extension and starter sections. Others have swelled one end of a shaft so as to form a female coupling for receiving an adjoining shaft. Such couplings are pre-drilled with multiple bolt holes that align with corresponding bolt holes in the adjoining ends of the starter and extension shafts. Bolts received through the aligned openings of the shafts and couplings act to secure the adjoining sections together.

Helical anchors of this type are generally torque-driven to bedrock, or to equal load-bearing strata which attains the installing torque that correlates to the required load-bearing capacity. As required load-bearing capacities increase, so does shaft and flight diameters, depth of installation, and consequently the required torque to install the anchors. As a consequence, it has been found that the greater torque generated at increased depths of installation causes coupling failures between the adjoining shaft sections. At or near the coupling joints, the pre-drilled holes in the shafts and inserts begin to tear laterally under excessive applied drive torque, thereby loosening and weakening the bolted joints, and ultimately causing catastrophic failure many feet below ground level. This is particularly true where the walls of the shafts are swelled and consequently thinned to form coupling ends. In other instances, excessive torque will lead to failure of the welded seams of the tubular shafts themselves, which also begin to split, thus causing further failure and weakening of the anchoring system. While the aforementioned conventional coupling system is adequate in applications requiring light to medium load-bearing capacities, it has proven to be insufficient for applications requiring increased load-bearing capacities and installation torque.

In addition to the above, the conventional coupling method utilizing coupling inserts is cumbersome to employ in that it includes multiple components, and is labor intensive and costly to implement. To couple adjoining drive shafts, a coupling insert must first be inserted within one shaft and bolted thereto utilizing a minimum of two (2) bolts. Then the adjoining shaft must be properly positioned over the remainder of the coupling insert and bolted thereto with a minimum of two (2) bolts. At each joint, a minimum of four (4) bolts are necessary to couple adjoining drive shafts together (2 for each shaft).

It is therefore evident that there is a distinct need for an improved means of coupling the drive shafts of helical anchors so as to withstand the significant forces exerted on such coupling devices in applications requiring increased load-bearing capacities and consequent increased drive torque for installation. It is also evident that the present coupling method is cumbersome, time consuming to implement, and would benefit through simplification. It is with these objects in mind that I have developed an improved helical anchor construction having an integrally-fabricated drive shaft coupling capable of withstanding increased torque under applications requiring significant load-bearing capacity.

SUMMARY OF INVENTION

In the present invention, the drive shaft of the helical anchor is machine fabricated with an integrally formed and hardened alloy steel coupling section which is adapted to mate with a similarly hardened and integrally formed corresponding coupling section of an extension shaft. The entire anchor is preferably constructed of alloy steel heat-treated to a yield and tensile strength in excess of about 80,000 psi. A substantial portion of the anchor's starter section, including the lower-most major portion of its drive shaft and flights welded thereto, are constructed of alloy steel having a carbon composition preferably in excess of approximately 0.25% by weight, and heat-treated to a yield and tensile strength of approximately 80,000 psi. The upper torque-receiving end of the drive shaft, however, includes an integrally formed and hardened coupling section which is constructed of alloy steel having a carbon composition preferably in excess of approximately 0.35% by weight, and heat-treated to a yield and tensile strength of approximately 135,000 psi, or greater.

In one embodiment of my invention, the hardened coupling section is comprised essentially of a hollow steel female tubular element, having the same or approximate inner and outer diametrical dimensions as that of the anchor's drive shaft, and at least a pair of pre-drilled bolt holes extending therethrough for attachment to a torque driving apparatus, or to additional extension shafts, as needed. The coupling section is fused to the upper end of the anchor's drive shaft through the use of an inertia friction welding process well known in the art. Inertia friction welding the coupling section and drive shaft together creates a fused joint between the two adjoining materials which is actually stronger than that of the remainder of the drive shaft. The drive shaft and integral coupling section are preferably constructed from hot-finished seamless steel tubing, and are fully galvanized to prevent corrosion and consequent deterioration of the anchor.

Additional extension shafts are also constructed of galvanized alloy steel throughout, but have corresponding integrally formed, hardened male and female coupling sections inertia friction welded to opposite ends thereof. Similar to the drive shaft of the anchor's starter section, an elongated intermediate section of each extension shaft is also composed of alloy steel having a carbon composition preferably in excess of approximately 0.25% by weight, and heat-treated to a yield and tensile strength of approximately 80,000 psi. The integral male and female coupling sections are constructed of hardened alloy steel having a carbon composition preferably in excess of approximately 0.35% by weight, and heat-treated to a yield and tensile strength which meets or exceeds approximately 135,000 psi.

The female coupling section of each extension shaft is a hollow tubular element configured identical to that which is fused to the upper end of the anchor's drive shaft. The male coupling section is also a hollow tubular element, but has an outer diameter just slightly less than the inner diameter of the female coupling section. This allows it to mate with corresponding female coupling sections carried by the drive shaft and other extension shafts. Similar to the female coupling section, the male coupling section has corresponding pre-drilled bolt holes which are configured and positioned to align with the holes of the female coupling sections to facilitate securement therebetween. Bolts received through the aligned openings of the male and female coupling sections act to secure the adjoining shafts together.

While not described in detail herein, it is certainly conceivable that such a male coupling section, rather than a female coupling section, could be inertia friction welded to the end of the helical anchor drive shaft. In this case, any extension shaft would simply be reversed to permit the female coupling section thereof to mate with the terminal male coupling section of the helical anchor. Preferably, the extension shafts, including the integral male and female coupling sections, are also constructed from hot-finished seamless steel tubing to increase the strength of the pipe, and are fully galvanized to prevent corrosion and consequent deterioration of the anchor.

In another embodiment, rather than utilizing bolts to secure the adjoining male and female coupling sections, the coupling sections are threaded. In this embodiment, the hardened female coupling section is again comprised of a hollow steel female tubular element with outer diametrical dimensions the same as or approximating that of the anchor's drive shaft. The interior surface of the female coupling, however, tapers radially inwardly from its free end and is threaded. The male coupling section is similarly constructed as a hollow tubular member, but has a threaded free end which is reverse-tapered for receipt in the tapered threaded end of the female coupling section.

An optional central transverse slot may be provided through the threaded tapered ends of both the male and female coupling sections. These slots are positioned in such manner that, upon threading adjoining male and female coupling sections together, the respective slots will become aligned and allow for insertion of a stress relief pin. The stress relief pin acts to absorb the extreme torque exerted on the anchor drive and extension shafts during drilling and prevents the threaded connection between the male and female coupling sections from becoming over tightened. This is important in the event an anchor and/or its extension shafts need to be backed out and disassembled for any reason.

As in the first embodiment, one such threaded coupling section is fused to the upper end of the anchor's drive shaft through the use of an inertia friction welding process, which effectively increases the strength of the joint. Each extension shaft is also constructed in a similar manner, with respective hardened steel male and female coupling sections inertia friction welded to the opposite ends thereof. The drive/extension shafts and integral coupling section(s) are constructed of the same materials as in the first embodiment, and are fully galvanized to prevent corrosion and consequent deterioration of the anchor.

Although the cost of the hardened material used for the shaft and coupling sections in the present invention is greater than that of commercial grade steel, such cost is recovered in savings of time, labor and materials in implementing the conventional coupling method utilizing coupling inserts. There is no longer need for a separate coupling insert, and fewer parts are required to secure adjoining shafts, since the coupling sections are permanently affixed to the drive and extension shafts, and may even be threaded for ease of connection. With fewer parts being required, the potential for misplacement of parts; the cumbersome task of aligning and securing multiple parts together; and the time associated therewith is significantly reduced.

Moreover, it is estimated that the combined shaft and coupling section of the present anchor is at least 5 times stronger than the conventional commercial grade steel utilized in conventional anchors. Thus, tearing and mutilation of the hardened coupling material under high torque conditions will be effectively eliminated, and since the inertia weld between the coupling section and shaft is stronger than the remainder of the shaft, there is little opportunity for failure at this joint either. With the drive and extension shafts constructed of hot-finished seamless steel tubing, rather than conventional welded hot or cold rolled tubing, the possibility of further cracking or tearing along a longitudinal weld is also eliminated. This will act to further strengthen the integrity of the shafts in general.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
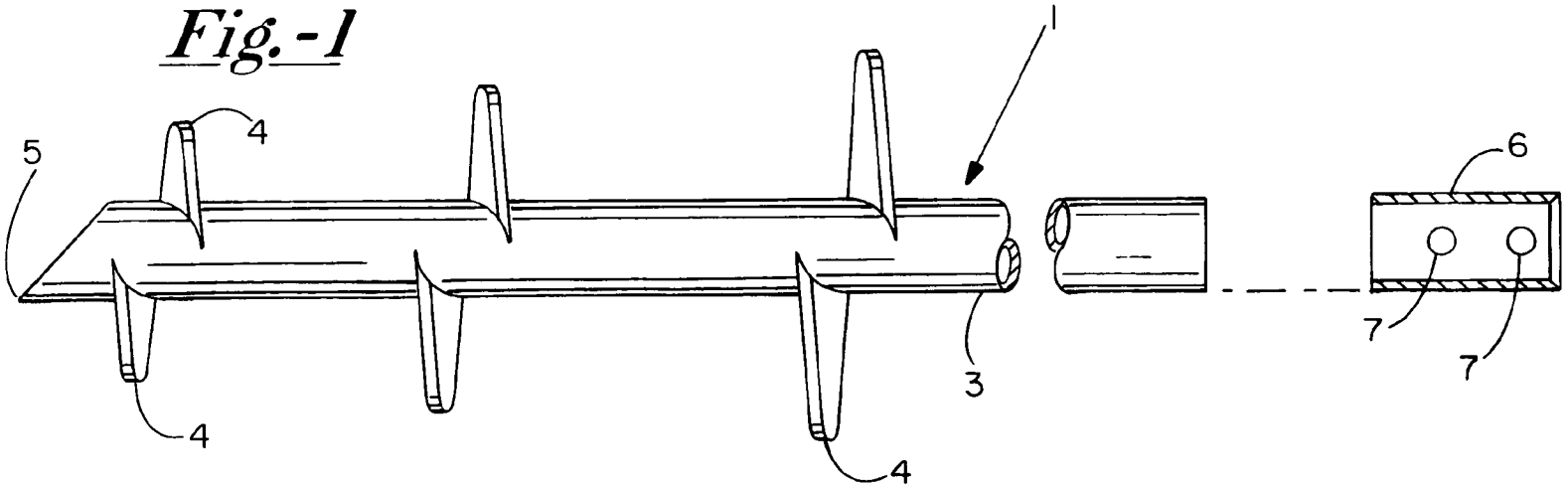
FIG. 1 is an exploded and partially cross-sectioned side elevational view of one embodiment of a helical anchor incorporating the principles of the present invention, showing the integrally-fabricated components of the main drive shaft and hardened coupling section.

As shown in FIG. 1, in accordance with the present invention, a structural pier device in the form of a helical anchor 1 is shown. The lower starter section of helical anchor 1 includes in general a main tubular drive shaft section 3 to which one or more helical flights or plates 4 are secured, as by welding. The lower end of drive shaft 3 tapers to a point 5 to facilitate penetration of the ground upon insertion of the anchor. Point 5 may take the form of and be constructed in any of a variety of ways, but in the preferred embodiment shown in FIG. 1, it is formed by cutting the lower end of the drive shaft 3 at a 45 degree angle, and leaving the end hollow.

Flights 4 are helically shaped to cause anchor 1 to be screwed into the ground upon rotation of the drive shaft 3. Each flight 4 secured to the main drive shaft section 3 increases in diameter as the distance from point 5 increases. As shown in FIG. 1, and as a general rule, the helical flights 4 are typically spaced along drive shaft 3 at intervals of about three (3) times the diameter of the next lower flight. Although the thickness of flights 4 may vary depending on the size of the flight and the application involved, as shown in FIG. 1, such flights are approximately ⅜" thick.

A major portion of helical anchor 1 and flights 4 welded thereto are constructed of galvanized hardened alloy steel to prevent corrosive deterioration of the anchor over time. The main drive shaft section 3 is preferably constructed from hot-finished normalized seamless alloy steel tubing, so as to eliminate the possibility of any cracking or rupturing of the longitudinal weld associated with conventional welded hot or cold rolled tubing. In the preferred embodiment, the main drive shaft section 3 and flights 4 are constructed of normalized alloy steel having a carbon composition preferably in excess of approximately 0.25% by weight, and heat-treated to a yield and tensile strength of approximately 80,000 psi.

In accordance with the present invention, the upper torque-receiving end of drive shaft 3 carries an integrally formed and hardened coupling section 6. Coupling section 6 is constructed as a round hot-finished seamless tubular steel section having the same inside and outside diametrical dimensions as the anchor's main drive shaft section 3. At least a pair of pre-drilled bolt holes 7 extend transversely through coupling section 6 to facilitate attachment of a torque driving apparatus, or additional extension shafts, as described hereafter. As shown, coupling section 6 is in the form of a female coupling element, but it is certainly contemplated that it may take the form of a male coupling element, without departing from the scope of the invention herein.

Coupling section 6 is preferably formed of hardened alloy steel having a carbon composition preferably in excess of approximately 0.35% by weight. In the preferred embodiment, it is contemplated that the integral coupling section 6 be formed of an AISI 4140 quenched and tempered, seamless hot-finished alloy steel tube that has been heat-treated to a yield and tensile strength approximating or exceeding 135,000 psi. This alloy has a carbon composition in the range of approximately 0.38-0.40% by weight.

The coupling section 6 is fused to the upper end of the anchor's main drive shaft section 3 through the use of an inertia friction welding process well known in the art. Inertia welding the coupling section 6 and drive shaft 3 together creates a fused joint between the two adjoining materials which is even stronger than that of the remainder of the drive shaft. The drive shaft 3 and integral coupling section 6 are both fully galvanized to prevent corrosion and consequent deterioration of the anchor. It is estimated that the resulting composite drive shaft is on the order of about 5 times stronger than the commercial stock tubing utilized in the construction of conventional helical anchors.

Figure 2:
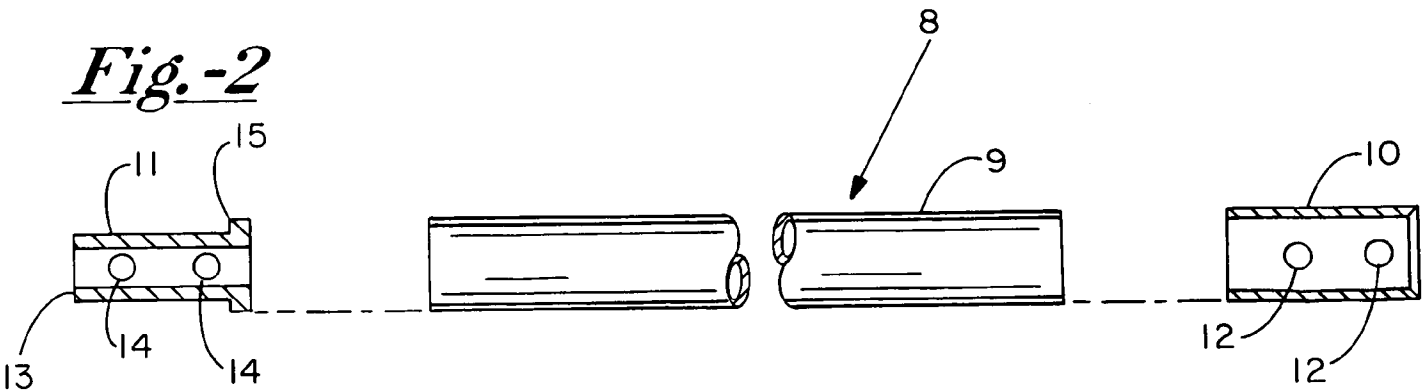
FIG. 2 is an exploded and partially cross-sectioned side elevational view of an extension shaft incorporating the principles of the present invention and intended for use with the helical anchor of FIG. 1, showing the integrally-fabricated components of the main extension shaft with hardened male and female coupling sections at opposite ends thereof.

As shown in FIG. 2, one or more extension shafts 8 are often utilized in conjunction with the starter section of helical anchor 1 for applications requiring deeper penetration underground. As depths of installation increase to reach more stable strata for better load-bearing capabilities, consequently, so does the required drive torque for installation. For this reason, in order to strengthen the extension shafts 8 and facilitate installation of the helical anchor, each extension shaft 8 is also machine fabricated to have integrally formed corresponding hardened coupling sections at opposite ends thereof.

As shown, extension shaft 8 includes an intermediate hollow round tubular section 9, the opposite ends of which carry integrally formed female coupling section 10 and male coupling section 11. As with drive shaft 3, this intermediate section 9 comprises the major portion of extension shaft 8, and has the same inner and outer diameter as drive shaft 3. Tubular section 9 is constructed throughout its length of normalized alloy steel, typically having a carbon composition on the order of about 0.25%, or more, and heat-treated to a yield and tensile strength meeting or exceeding about 80,000 psi. It is also galvanized to prevent corrosion and consequent deterioration thereof. While tubular section 9 may be constructed by any suitable method known in the art, in the preferred embodiment, it is manufactured from hot-finished seamless tubing to eliminate any longitudinal weld. The use of such seamless tubing further prevents the possibility of the extension shaft 8 splitting or cracking along such a weld created through other methods, as the installation drive torque increases.

Integrally formed coupling section 10 is constructed in an identical manner as female coupling section 6 fused to drive shaft section 3 of anchor 1. It has the same inner and outer diametrical dimensions as drive shaft 3 and coupling 6, and is similarly formed of hardened alloy steel having a carbon composition preferably in excess of approximately 0.35% by weight. Similar to coupling section 6, in the preferred embodiment, it is contemplated that the integral coupling section 10 be formed from an AISI 4140 quenched and tempered, seamless hot-finished alloy steel tube, that has been heat-treated to a yield and tensile strength of approximately 135,000 psi, or more. Again, this alloy preferably has a carbon composition in the range of approximately 0.38-0.40% by weight. Coupling section 10 of extension shaft 8 also includes at least a pair of pre-drilled bolt holes 12 adapted to provide an attachment means for a torque driving apparatus, or to additional extension shafts, as needed.

The male coupling section 11, which is integrally formed on the opposite end of intermediate tubular section 9 of shaft 8, is constructed of the same hardened material as coupling sections 6 and 10. Coupling section 11 is similarly constructed in the form of a hollow seamless tubular member, but has a reduced free end portion 13 having an outer diameter just slightly less than the inner diameter of the female coupling sections 6 and 10. This facilitates insertion of the free end 13 within the tubular opening of the drive shaft coupling 6, or if desired, within coupling section 10 of another extension shaft 8.

Figure 3:
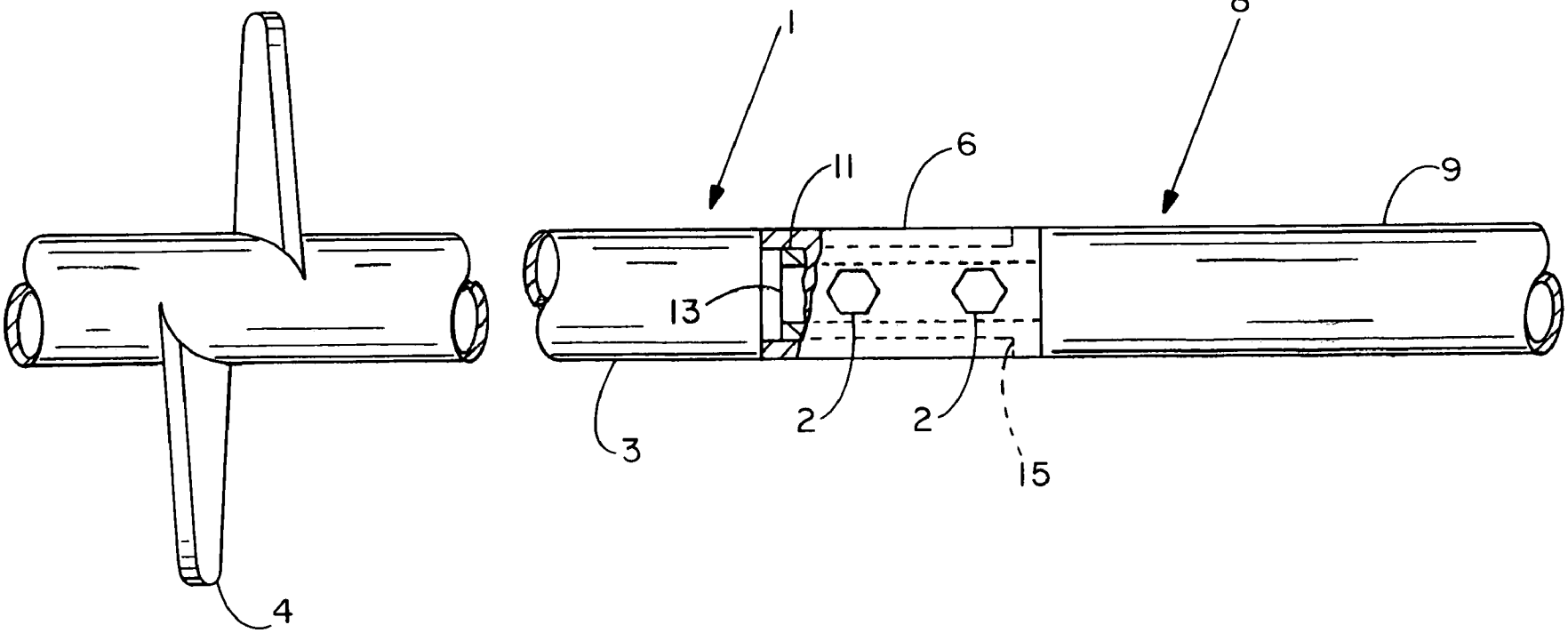
FIG. 3 is an partial side elevational view of the joint between the helical anchor drive shaft of FIG. 1 and extension shaft of FIG. 2, partially sectioned at the joint to show the engagement of corresponding male and female coupling sections thereof.

The inner diameter of the male coupling section 11 is also reduced relative to that of the female coupling sections 6 and 10, and as shown in FIG. 2, the overall wall thickness thereof is increased relative to the remainder of extension shaft 8 so as to strengthen the joint between the male and female coupling sections upon joinder thereof. Since it is more difficult to form a seamless steel tubular member having a reduced inner diameter and thicker walls through a hot-finishing extrusion process, it is contemplated that the male tubular coupling section 11 may alternatively be manufactured by drilling a longitudinal bore through a solid bar of hot-rolled steel, or by hot-forging the coupling section 11 through techniques well known in the art. As shown in FIG. 3, corresponding pre-drilled bolt holes 14 extending transversely through the male coupling section 11 are then configured and positioned to align with the pre-drilled bolt holes in either of the female coupling sections 6 or 10. Bolts 2 are received through the aligned bolt holes in the male and female coupling sections and secure the adjoining shafts together.

The opposite end of the male coupling 11 forms an annular shoulder 15 extending circumferentially therearound. Shoulder 15 has an outer diameter that preferably matches that of intermediate tubular section 9 and provides a base to which tubular section 9 is fused during fabrication. As seen in FIG. 3, shoulder 15 also serves to act as a stop against which adjoining female coupling sections bear for proper alignment of the corresponding bolt holes.

Fabrication of the starter section of helical anchor 1 and extension shaft 8 is very similar in that fusion of the coupling sections to their respective shafts is accomplish in the same manner through the use of inertia friction welding. With respect to the starter section of helical anchor 1, although it is contemplated that hot or cold-rolled, welded tubing may be sufficient in certain applications, in the preferred embodiment, the main drive shaft section 3 is first hot-finished into a seamless tubular element, as shown in FIG. 1. Through frictional heat generated by the high speed rotation of inertia welding, drive shaft 3 and the hardened seamless tubular coupling section 6 are literally melted or fused together as an integrally formed joint which is stronger than the existing stock from which the main drive shaft section 3 is constructed. The lower end of drive shaft 3 may then be cut to form point 5, and one or more flights 4 are spaced and welded along the shaft's length to complete the starter section.

Similarly, each extension shaft 8 is constructed by first hot-finishing its extended intermediate section 9 into a seamless tubular element in the same manner as drive shaft 3, utilizing the same or similar material and diametrical dimensions thereof. Both the female coupling section 10 and male coupling section 11 are then independently fused to opposite ends of the intermediate tubular section 9 utilizing the same inertia friction welding techniques as previously discussed. Preferably, both female coupling sections 6 and 10 are constructed of hot-finished seamless tubing, and the seamless male coupling section 11 is formed through a hot-forging process or by boring through a hot-rolled solid steel bar to further enhance and ensure the strength of the coupled joints. The resulting composite extension shaft 8 with integral hardened coupling sections 10 and 11 is also estimated to be approximately 5 times greater in strength that conventional shafts composed of commercial grade steel. As stated previously, the resulting anchor 1 and extension shafts 8 are all fully galvanized to prevent deterioration due to corrosion over time.

Figure 4:
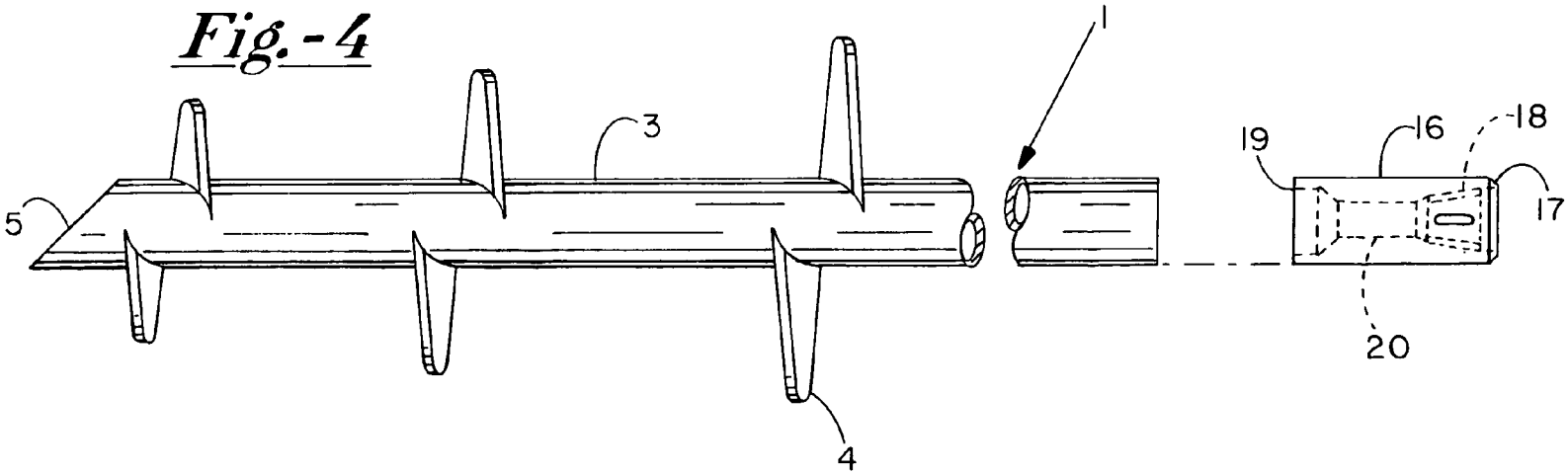
FIG. 4 is an exploded and partially cross-sectioned side elevational view of a second embodiment of a helical anchor incorporating the principles of the present invention, showing the integrally-fabricated components of the main drive shaft and hardened threaded coupling section.
Figure 5:
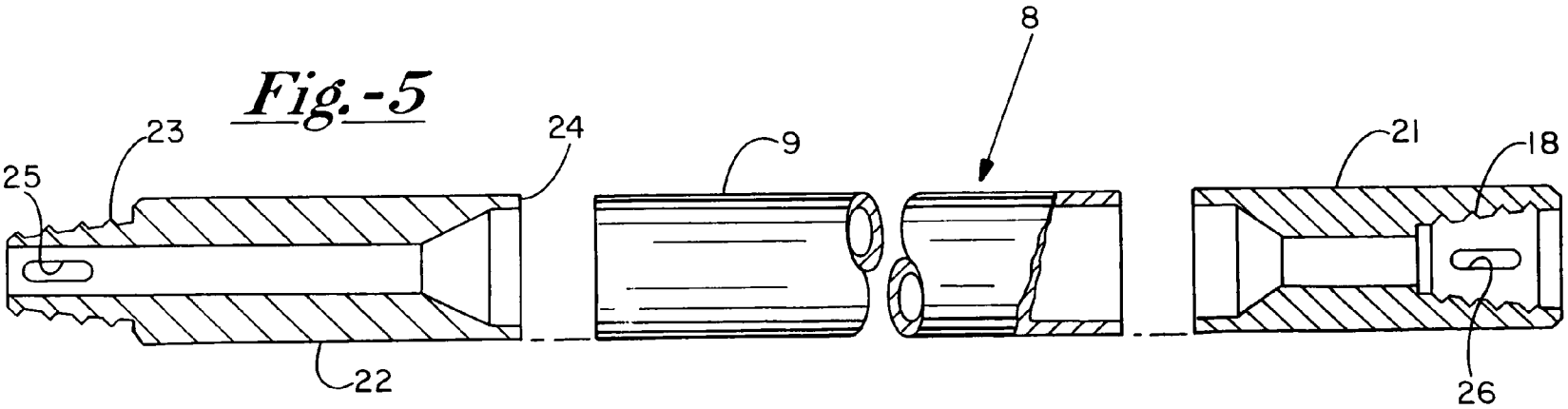
FIG. 5 is an exploded and partially cross-sectioned side elevational view of an extension shaft incorporating the principles of the present invention and intended for use with the helical anchor of FIG. 4, showing the integrally-fabricated components of the main extension shaft with hardened male and female threaded coupling sections at opposite ends thereof.
Figure 6:
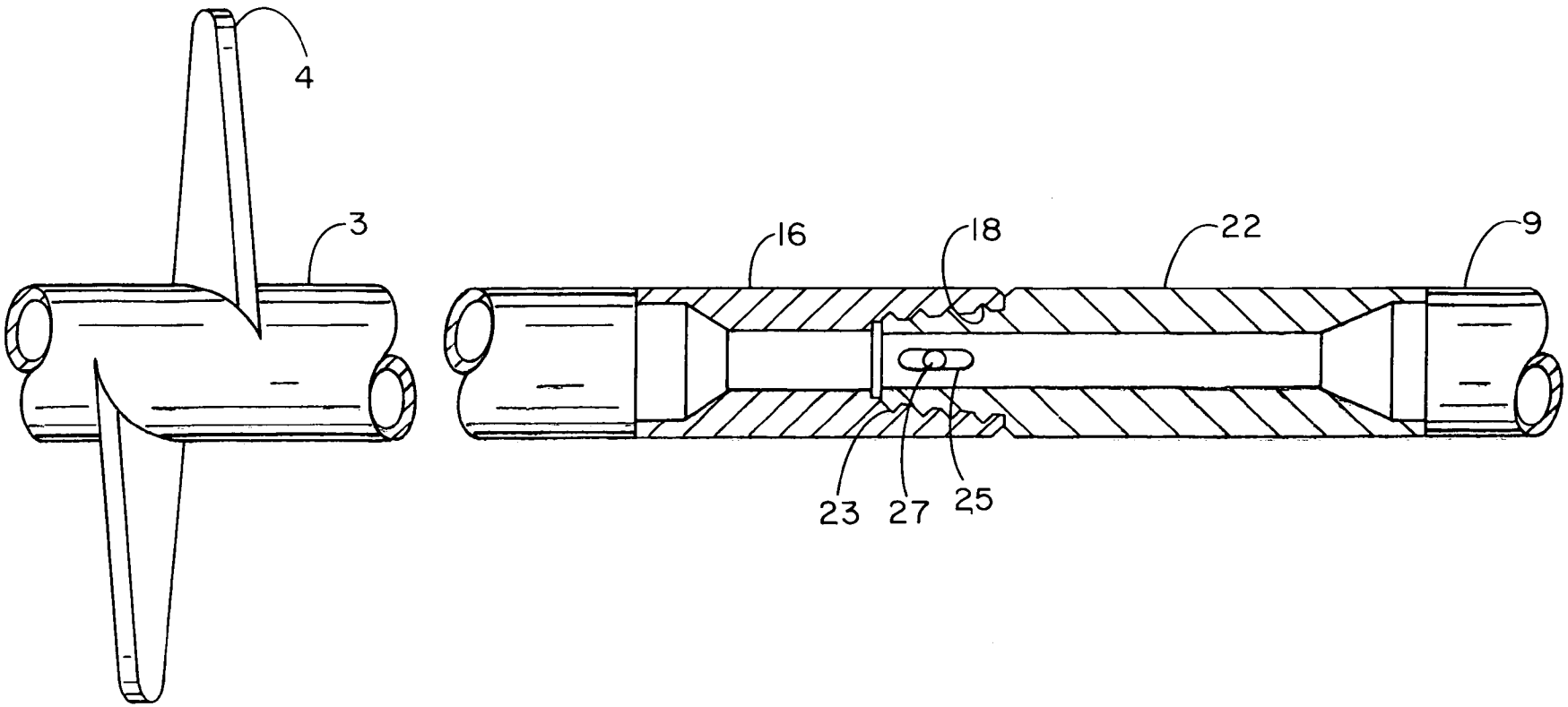
FIG. 6 is an partial side elevational view of the joint between the helical anchor drive shaft of FIG. 4 and extension shaft of FIG. 5, partially sectioned at the joint to show the inter-engagement of corresponding threaded male and female coupling sections thereof.

In another embodiment, as shown in FIGS. 4-6, rather than utilizing bolts to secure the adjoining male and female coupling sections of the drive shaft 3 and extension shaft 8, the coupling sections are threaded. In this embodiment, the hardened female coupling section 16 which is integrally formed on the end of drive shaft 3 is again comprised of a hollow steel female tubular element with outer diametrical dimensions the same as or approximating that of the anchor's drive shaft 3. The interior surface of the female coupling 16, however, tapers radially inwardly from its free end 17 toward drive shaft 3, and includes threads 18. The interior surface of coupling 16 also tapers radially inwardly from its opposite end 19 toward end 17, thereby defining an intermediate portion 20 that is thicker than its opposite ends. The inner diameter at end 19 coincides with that of drive shaft 3 and/or intermediate section 9 of extension shaft 8 to facilitate alignment and inertia welding thereto in a manner as describe above.

As shown in FIG. 5, in the alternative embodiment, extension shaft 8 includes a female coupling section 21 at one end which is constructed identical to coupling section 16 carried by drive shaft 3. An alternative male coupling section 22 is integrally formed on the opposite end of extension shaft 8. While male coupling section 22 is also constructed as a hollow tubular member, it has a threaded free end 23 which is reverse-tapered for receipt in and engagement with the tapered threaded end 17 of a corresponding female coupling section 16, as shown in FIG. 6. Similar to coupling section 16, male coupling section 22 has a thicker wall which tapers outwardly at its end 24 to a thickness corresponding to drive shaft 3 and/or intermediate section 9 of extension shaft 8 so as to facilitate alignment and inertia welding thereto.

As can be seen in FIGS. 4-6, both the male coupling section 22 and female coupling sections 16, 21 may include an optional central transverse slot 25, 26, respectively, extending therethrough. Slots 25 and 26 are positioned in such manner that, upon threading an adjoining male coupling section 22 into a female coupling section 16, 21, the respective slots will become aligned and allow for insertion of a stress relief pin 27. The stress relief pin 27 acts to absorb the extreme torque exerted on the anchor drive and extension shafts 3 and 8 during drilling and to prevent the threaded connection between the male and female coupling sections from becoming over-tightened. This is important in the event an anchor 1 and/or its extension shafts 8 need to be backed out and disassembled for any reason.

Although other manufacturing methods are certainly available, given the interior profiles of coupling sections 16, 21 and 22, it is contemplated that they be either hot-forged or formed by boring through a hot-rolled solid steel bar, with the threads 18, 23 subsequently machined therein. Similar to coupling sections 6, 10 and 11 of the first embodiment, it is intended that coupling sections 16, 21 and 22 all be formed from a hardened alloy steel having a carbon composition preferably in excess of approximately 0.35% by weight, such as AISI 4140 quenched and tempered, seamless hot-finished alloy steel, that has been heat-treated to a yield and tensile strength of approximately 135,000 psi, or more.

As in the first embodiment, one such threaded coupling section 16, 22 is fused to the upper end of the anchor's drive shaft 3 through the use of an inertia friction welding process, which effectively increases the strength of the joint. Each extension shaft 8 is also constructed in a similar manner, with respective hardened steel male 22 and female 21 coupling sections inertia friction welded to the opposite ends thereof. Also, as in the previous embodiment, the drive/extension shafts and integral coupling section(s) are fully galvanized to prevent corrosion and consequent deterioration of the anchor.

It can be seen from FIGS. 3 and 6 that upon joining an extension shaft 8 to the drive shaft 3 of the lower starter section of helical anchor 1, or to another similarly constructed extension shaft, the resulting joint is comprised of coupling sections constructed entirely of superiorly hardened non-corrosive steel that will not tear or become mutilated under the extreme drive torque conditions that are often experienced in applications involving deep earth installation for high load-bearing capacities. Moreover, since the inertia welds between the respective coupling sections and shafts are stronger than the remainder of the shaft, there is little opportunity for failure at this joint either. Provided the shafts and coupling sections are constructed as heat-treated, hardened and seamless alloy steel tubular members, the possibility of cracking along a longitudinal weld will also be effectively eliminated, thus further strengthening the integrity of the shafts in general.

Although the cost of the hardened material used for the shafts and coupling sections is greater than that of commercial grade steel, such cost is recovered in savings of time, labor and materials normally associated with implementing the conventional coupling method utilizing coupling inserts. There is no longer need for a separate coupling insert, and fewer bolts are require to secure adjoining shafts, since the coupling sections are permanently affixed to the drive and extension shafts. Fewer parts are required, significantly reducing the potential for misplacement of parts and the cumbersome task of aligning and securing multiple parts together.

It will, of course, be understood that various changes may be made in the form, details, arrangement and proportions of the parts without departing from the scope of the invention which comprises the matter shown and described herein and set forth in the appended claims.

The invention claimed is:

1. A helical anchor device, comprising:

(a) an integrally-fabricated one-piece composite drive shaft having a main shaft section and a terminal coupling section inertia friction welded in permanently affixed coaxial relation to said main shaft section;

(b) said main shaft section being composed of a hardened alloy steel tubular member;

(c) said coupling section being composed of a hardened alloy steel tubular member having a higher carbon content than said main shaft section and a yield and tensile strength substantially exceeding that of said main shaft section; and d) a plurality of helically-shaped plates secured to said drive shaft at spaced intervals thereon.

2. The helical anchor defined in claim 1, wherein said main shaft section has a yield and tensile strength of at least about 80,000 pounds per square inch.

3. The helical anchor defined in claim 1, wherein said main shaft section has a carbon composition of at least about 0.25% by weight.

4. The helical anchor defined in claim 1, wherein said coupling section has a carbon composition of at least about 0.35% by weight.

5. The helical anchor defined in claim 1, wherein said coupling section has a carbon composition within the range of approximately 0.38-0.40% by weight.

6. The helical anchor defined in claim 1, wherein said coupling section has a yield and tensile strength of at least about 135,000 pounds per square inch.

7. The helical anchor defined in claim 1, further comprising:

(e) an integrally-fabricated composite extension shaft, said extension shaft including a first end coupling, an intermediate shaft section, and a second end coupling;

(f) said intermediate shaft section being composed of a hardened alloy steel tubular member;

(g) said end couplings of said extension shaft each being composed of a hardened alloy steel tubular member having a higher carbon content than said intermediate shaft section and a yield and tensile strength substantially exceeding that of said intermediate shaft section; and (h) said end couplings being inertia friction welded to opposites ends of said intermediate shaft section.

8. A helical anchor device, comprising:

(a) an integrally-fabricated composite drive shaft having a main shaft section and a terminal coupling section, and being constructed throughout of seamless hot-finished hardened alloy steel tubing;

(b) said main shaft section being composed of normalized alloy steel having a carbon composition of at least about 0.25% by weight and a yield and tensile strength of at least 80,000 pounds per square inch;

(c) said coupling section being composed of quenched and tempered alloy steel having a higher carbon content than said main shaft section and a yield and tensile strength substantially exceeding that of said main shaft section, said coupling section having a carbon composition of at least about .35% by weight and a yield and tensile strength of at least 135,000 pounds per square inch, said coupling section being inertia friction welded to said main shaft section; and (d) a plurality of helically-shaped plates secured to said drive shaft at spaced intervals thereon.

9. A helical anchor device, comprising:

(a) an integrally-fabricated composite drive shaft having a main shaft section and a terminal coupling section;

(b) said main shaft section being composed of a hardened alloy steel tubular member;

(c) said coupling section being composed of a hardened alloy steel tubular member having a higher carbon content than said main shaft section and a yield and tensile strength substantially exceeding that of said main shaft section, said coupling section being inertia friction welded to said main shaft section;

(d) a plurality of helically-shaped plates secured to said drive shaft at spaced intervals thereon; and (e) said coupling section of said drive shaft including at least one bore extending transversely therethrough which aligns with a corresponding bore extending transversely through a mating coupling section of an extension shaft, said aligned bores being adapted to receive a coupling locking member extending through and between said coupling sections of said drive shaft and said extension shaft.

10. The helical anchor defined in claim 9, wherein said coupling section of said drive shaft telescopically engages said coupling section of said extension shaft.

11. The helical anchor defined in claim 9, wherein said coupling section of said drive shaft threadably engages said coupling section of said extension shaft.

12. A helical anchor device, comprising:

(a) an integrally-fabricated composite drive shaft having a main shaft section and a terminal coupling section. and being constructed throughout of seamless hot-finished hardened alloy steel tubing;

(b) said main shaft section being composed of normalized alloy steel having a carbon composition of at least about 0.25% by weight and a yield and tensile strength of at least 80,000 pounds per square inch;

(c) said coupling section being composed of quenched and tempered alloy steel having a higher carbon content than said main shaft section and a yield and tensile strength substantially exceeding that of said main shaft section, said coupling section having a carbon composition of at least about 0.35% by weight and a yield and tensile strength of at least 135,000 pounds per square inch, said coupling section being inertia friction welded to said main shaft section;

(d) a plurality of helically-shaped plates secured to said drive shaft at spaced intervals thereon;

(e) an integrally-fabricated composite extension shaft, said extension shaft including a first end coupling, an intermediate shaft section, and a second end coupling, said extension shaft being constructed throughout of seamless hot-finished hardened alloy steel tubing;

(f) said intermediate shaft section being composed of normalized alloy steel having a carbon composition of at least about 0.25% by weight and a yield and tensile strength of at least 80,000 pounds per square inch;

(g) said end couplings of said extension shaft being composed of quenched and tempered alloy steel having a higher carbon content than said intermediate shaft section and a yield and tensile strength substantially exceeding that of said intermediate shaft section, said end couplings of said extension shaft being composed of quenched and tempered alloy steel having a carbon composition of at least about 0.35% by weight and a yield and tensile strength of at least 135,000 pounds per square inch; and (h) said end couplings being inertia friction welded to opposites ends of said intermediate shaft section.

13. A helical anchor drive shaft, comprising:

(a) an elongated integrally-fabricated one-piece composite shaft member having a main shaft section with opposite ends and a terminal coupling section permanently affixed in coaxial relation to one of said ends;

(b) said main shaft section being constructed throughout of a seamless hot-finished hardened alloy steel tubular member;

c) said terminal coupling section being constructed throughout of a seamless hardened alloy steel member having a higher carbon content than said main shaft section and a yield and tensile strength substantially exceeding that of said main shaft section;

(d) said terminal coupling section being inertia friction welded to said main shaft section.

14. The helical anchor drive shaft defined in claim 13, wherein said main shaft section is composed of normalized alloy steel having a carbon composition of at least about 0.25% by weight and a yield and tensile strength of at least 80,000 pounds per square inch, and said terminal coupling section is composed of quenched and tempered alloy steel having a carbon composition of at least about 0.35% by weight and a yield and tensile strength of at least 135,000 pounds per square inch.

15. The helical anchor drive shaft defined in claim 13, wherein said shaft member includes a pair of said terminal coupling sections, one of said pair of coupling sections being inertia friction welded to each of said opposite ends of said main shaft section.

16. The helical anchor drive shaft defined in claim 15, wherein one of said pair of coupling sections constitutes a tapered threaded male coupler and said other of said pair of coupling sections constitutes a reverse-tapered female coupler with corresponding threads adapted to mate with said threads of another said male coupler of an adjoining said shaft member.

* * * * *

UNITED STATES PATENT AND TRADEMARK OFFICE

CERTIFICATE OF CORRECTION

PATENT NO. : 7,510,350 B2
APPLICATION NO. : 11/787171
DATED : March 31, 2009
INVENTOR(S) : Thomas Ronnkvist It is certified that error appears in the above-identified patent and that said Letters Patent is hereby corrected as shown below:

Col. 10, Claim 1, line 32, subparagraph "d)" should read --(d)--.

Col. 11, Claim 12, line 47, subparagraph (a), line 2, "coupling sections." should read --coupling sections,--.

Col. 12, Claim 13, line 33, subparagraph "c)" should read --(c)--.

Signed and Sealed this

Eleventh Day of August, 2009

David J. Kappos

David J. Kappos
*Director of the United States Patent and Trademark Office*